US012760975B2

(12) United States Patent
Strömer et al.

(10) Patent No.: US 12,760,975 B2
(45) Date of Patent: Oct. 13, 2026

(54) HEAT EXCHANGER PLATE MODULE, A PLATE HEAT EXCHANGER AND A PROCESS FOR THE PRODUCTION OF THE PLATE HEAT EXCHANGER

(71) Applicant: ALFA LAVAL CORPORATE AB, Lund (SE)

(72) Inventors: Fredrik Strömer, Kävlinge (SE); Håkan Larsson, Degeberga (SE); Arne Borg, Kågeröd (SE); Mats Nilsson, Lund (SE); Henrik Kockum, Lund (SE)

(73) Assignee: ALFA LAVAL CORPORATE AB, Lund (SE)

( * ) Notice: Subject to any disclaimer, the term of this patent is extended or adjusted under 35 U.S.C. 154(b) by 564 days.

(21) Appl. No.: 18/249,300

(22) PCT Filed: Oct. 11, 2021

(86) PCT No.: PCT/EP2021/078032
§ 371 (c)(1),
(2) Date: Apr. 17, 2023

(87) PCT Pub. No.: WO2022/084083
PCT Pub. Date: Apr. 28, 2022

(65) Prior Publication Data

US 2023/0392881 A1 Dec. 7, 2023

(30) Foreign Application Priority Data

Oct. 23, 2020 (EP) ..... 20203708

(51) Int. Cl.
*F28F 3/12* (2006.01)
*F28D 9/00* (2006.01)

(52) U.S. Cl.
CPC ..... *F28F 3/12* (2013.01); *F28D 9/005* (2013.01)

(58) Field of Classification Search
CPC ..... F28D 9/005; F28D 9/0062; F28D 9/0037; F28D 9/0043; F28D 9/0075; F28F 3/12;
(Continued)

(56) References Cited

U.S. PATENT DOCUMENTS 3,198,248 A 8/1965 Noel
3,517,733 A 6/1970 Tasker et al.
(Continued)

FOREIGN PATENT DOCUMENTS

CN 1847767 A 10/2006
CN 104380022 A 2/2015
(Continued)

OTHER PUBLICATIONS

Extended European Search Report dated Apr. 9, 2021, issued by the European Patent Office in corresponding European Application No. 20203708.1. (7 pages).
(Continued)

*Primary Examiner* — Tho V Duong
(74) *Attorney, Agent, or Firm* — BUCHANAN INGERSOLL & ROONEY PC

(57) ABSTRACT

A heat exchanger plate module comprises a pressed heat exchanger plate and a flat plate, and a heat exchanger comprises plural of the modules. The plates comprise first and second longitudinal end portions each having a fluid port, and an intermediate heat exchange portion between the first and second longitudinal end portions. The plates further include a pressed corrugated pattern with alternating tops and bottoms in the thickness direction. The pressed pattern comprises in the first and/or second longitudinal end portions, a first fluid channel pattern leading fluid flow into the
(Continued)

Figure 1A:
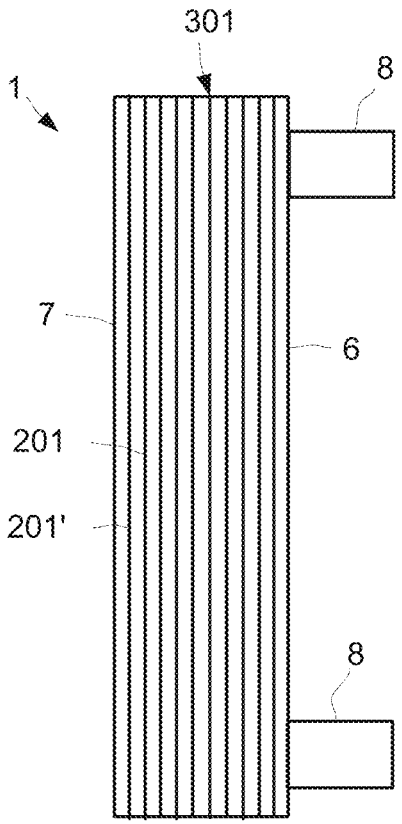

fluid port and/or a second fluid channel pattern bypassing the fluid port. In the intermediate heat exchange portion, a third fluid channel pattern fluidly communicates with the first and/or second fluid channel pattern and comprises longitudinally extending wave-shaped pressed lines that form discrete longitudinal extending fluid channels, when the pressed heat exchanger plate is attached to the flat plate.

19 Claims, 12 Drawing Sheets

(58) Field of Classification Search
CPC ..... F28F 3/046; F28F 3/083; F28F 2250/06; F28F 2255/08; B23P 15/26
See application file for complete search history.

(56) References Cited

U.S. PATENT DOCUMENTS

| | | | | |
|---|---|---|---|---|
| 4,183,403 | A | 1/1980 | Nicholson | |
| 6,237,679 | B1 | 5/2001 | Vestergren | |
| 6,530,425 | B2 * | 3/2003 | Wehrmann | F28D 9/0093 165/166 |
| 9,453,685 | B2 * | 9/2016 | Miao | F28F 3/027 |
| 9,797,636 | B2 | 10/2017 | Wagner et al. | |
| 2004/0256083 | A1 | 12/2004 | Rehberg et al. | |
| 2015/0122468 | A1 | 5/2015 | Bertilsson et al. | |
| 2015/0285572 | A1 | 10/2015 | Fleitling et al. | |
| 2017/0023312 | A1 | 1/2017 | Urbanski | |
| 2017/0248373 | A1 | 8/2017 | Uchino | |
| 2019/0063846 | A1 | 2/2019 | Bluetling | |
| 2019/0346220 | A1 | 11/2019 | Sjödin et al. | |
| 2020/0386493 | A1 | 12/2020 | Norén | |

FOREIGN PATENT DOCUMENTS

| | | | | |
|---|---|---|---|---|
| CN | 109791024 | A | 5/2019 | |
| CN | 111316057 | A | 6/2020 | |
| CN | 111457764 | A * | 7/2020 | F28D 9/005 |
| DE | 102009043828 | A1 | 4/2011 | |
| DE | 202016002578 | U1 * | 8/2017 | F01M 5/002 |
| EP | 2998676 | A1 * | 3/2016 | F28F 3/025 |
| EP | 3040670 | A1 | 7/2016 | |
| EP | 3088830 | A1 | 11/2016 | |
| EP | 3396293 | A1 | 10/2018 | |
| GB | 718991 | A | 11/1954 | |
| JP | S4844842 | A | 6/1973 | |
| JP | 2003287382 | A | 10/2003 | |
| JP | 2006525485 | A * | 11/2006 | F28D 9/005 |
| JP | 2007183071 | A | 7/2007 | |
| JP | 2019531457 | A | 10/2019 | |
| RU | 2164332 | C2 | 3/2001 | |
| SE | 1651317 | A1 * | 4/2018 | F28D 9/005 |
| TW | 201839344 | A | 11/2018 | |
| WO | 2005083343 | A1 | 9/2005 | |
| WO | 2009024953 | A2 | 2/2009 | |
| WO | 2009/151399 | A1 | 12/2009 | |
| WO | 2016110472 | A1 | 7/2016 | |
| WO | WO-2017138322 | A1 * | 8/2017 | F28F 3/022 |
| WO | 2018065170 | A1 | 4/2018 | |
| WO | 2020200678 | A1 | 10/2020 | |

OTHER PUBLICATIONS

International Search Report (PCT/ISA/210) and Written Opinion (PCT/ISA/237) mailed on Nov. 9, 2021, by the European Patent Office as the International Searching Authority for International Application No. PCT/EP2021/078032. (15 pages).

Office Action (Notice of Reasons for Rejection) issued on Jul. 1, 2024, in corresponding Japanese Patent Application No. 2023-524773 and machine English translation of the Office Action. (13 pages).

Office Action/Search Report (Text of First Office Action) issued on Nov. 24, 2025, in corresponding Chinese Patent Application No. 202180071867.4 and English translation of the Office Action/Search Report. (17 pages).

Notice of Allowance issued on Jun. 29, 2026, by the National Intellectual Property Administration, People's Republic of China in Chinese Patent Application No. 202180071867.4 and an English translation. (7 pages).

* cited by examiner

HEAT EXCHANGER PLATE MODULE, A PLATE HEAT EXCHANGER AND A PROCESS FOR THE PRODUCTION OF THE PLATE HEAT EXCHANGER

FIELD OF THE INVENTION

The present invention relates to a heat exchanger plate module comprising a pressed plate and a flat plate as defined in the introductory parts of the independent claims attached herein. The disclosure also relates to a plate heat exchanger as defined in the introductory parts of the independent claims attached herein. Furthermore, the disclosure also relates to a process for the production of the plate heat exchanger.

BACKGROUND ART

Plate heat exchangers, or PHEs, are heat exchangers which typically comprise a plurality of metallic heat transfer plates arranged in an aligned manner in a stack. The metal plates are used to separate two fluids and transfer heat between the fluids. In the plate heat exchanger, fluids of different temperatures are distributed over a respective surface of the plates, which can comprise a number of fins providing an increased heat exchange area. The fins may be provided by corrugating the plates. The stack of heat exchanger plates may be arranged between end plates and all the plates may be joined for example by welding or brazing. In some variants pressure plates, which press the heat exchanger plates and the end plates towards each other, may be used. To be able to transfer heat between the fluids, flow channels for the respective fluids are needed, and this can be achieved in different manners depending on the heat exchanger type and the fluids in questions.

There are different types of plate heat exchangers (PHE) and the plate heat exchangers may be adapted for different types of thermal fluids. Well-known PHEs include for example brazed or fusion-bonded heat exchangers, in which the flows of the thermal fluids are normally arranged in a counter current manner in separate channels. No gaskets or similar are used to separate the fluids. There are also so called gasketed plate heat exchangers (GPHE), in which gaskets are arranged between the heat transfer plates to ensure that thermal fluids do not mix with each other. In the heat exchangers flow channels are usually defined between the heat transfer plates through which channels fluids of initially different temperatures can flow for transferring heat from one fluid to the other. In the brazed or fusion-bonded heat exchangers, plates with troughs which form parallel flow channels with alternating hot and cold fluids may be used. A known type of a brazed plate heat exchanger is disclosed by GB718991. The document shows a heat exchanger with plates forming a heat exchanger surface with alternating corrugated and flat plates, wherein each fluid is arranged to flow on both sides of a corrugated plate. However, in the assembly of the plate heat exchanger, several components are needed, i.e. for example corrugated strips with slits, which need to be fixed in the space enclosed by the side walls and a metal disc.

Despite existing plate heat exchanger solutions, there is still a need for improvements in plate heat exchangers. Especially, there is a need for plate heat exchangers which are compact, which are simple to manufacture and require minimum amount of metal raw material. Additionally, there is a need for plate heat exchangers, which are suitable for use in connection with high pressures, especially for example from 100 bar upwards. There is also a desire for heat exchangers suitable for use for heat exchange between hot and cold gases, especially when at least one of the gases is provided at high pressure, herein referred to as High pressure Gas (HPG) plate technology.

SUMMARY

It is an objective of the present invention to mitigate, alleviate or eliminate one or more of the above-identified disadvantages in the prior art and provide solutions for heat exchanger plates whereby the design of the heat exchanger plate is robust and allows for efficient heat exchange in different types of plate heat exchangers.

It is also an objective to provide a heat exchanger plate, which is suitable for use in high pressures.

It is a further objective to provide a manufacturing method requiring a minimum amount of metal raw materials.

It is also an objective to reduce the costs for the plates.

Additionally, there is a desire to increase the area used for heat exchanging process on the plate. Therefore, it is a further objective of the present invention to enable an increased utilization of a plate area for heat exchange.

The above-mentioned objectives are attained by the present invention as defined in the appended claims.

According to a first aspect, there is provided a heat exchanger plate module comprising a pressed heat exchanger plate and a flat plate, wherein the pressed heat exchanger plate and the flat plate have two opposite side surfaces, an extension in a longitudinal direction, transversal direction perpendicular to the longitudinal direction, and thickness direction of the plate. The plates, i.e. both the pressed and the flats plates, have substantially the same outer shape in the longitudinal and transversal direction, and the plates in the module comprise:

- a first longitudinal end portion comprising at least one fluid port,
- a second longitudinal end portion comprising at least one fluid port, and
- an intermediate heat exchange portion arranged in between the first and second longitudinal end portions.

The pressed heat exchanger plate further comprises a pressed corrugated pattern with alternating tops and bottoms in the thickness direction of the plate. Especially, the pressed pattern comprises:

- in the first and/or second longitudinal end portions, a first fluid channel pattern leading fluid flow into the at least one fluid port and/or a second fluid channel pattern bypassing the at least one fluid port,
- in the intermediate heat exchange portion, a third fluid channel pattern in fluid communication with the first fluid channel pattern and/or a second fluid channel pattern, and comprising a plurality of longitudinally extending wave-shaped pressed lines configured to form discrete fluid channels in the longitudinal direction of the heat exchanger plate module, when the pressed heat exchanger plate is attached to the flat plate.

By the heat exchanger plate module of the present invention, in which the pressed plates comprise integrated fluid ports and in which the pressed fluid channel patterns allow the fluid to flow-through or by-pass the integrated ports and provide a large heat exchanging area in between the ports, a robust heat exchanger plate module, which allows for efficient heat exchange in different types of plate heat exchangers is provided. Due to the robust construction of the plate module the modules are suitable for use in plate heat exchangers configured for high fluid pressures or heat exchangers having large differential pressures between the hot and cold fluids. Further, due to the structure of the heat exchanger plate module with integrated ports and the specific fluid channel patterns, the thickness of the plates may be reduced compared to the prior art solutions, thereby requiring a minimum amount of metal raw materials. Thereby, it is possible to reduce the costs for the plates. Additionally, the structure provides a large heat exchanging area, due to the flow channel patterns in the pressed plates.

To ensure that the modules are fluid-tight, the flat plate is attached to the pressed heat exchanger plate along the extension of the first, second and third fluid channel patterns.

The first fluid channel pattern and/or the second fluid channel pattern may form a discontinuous pattern with the third fluid channel pattern. The discontinuous pattern may comprise an interrupting portion between the first and/or the second fluid channel patterns and the third fluid channel pattern. This way, it is possible to facilitate the transition of the fluid flow between the first and/or the second fluid channel pattern and the third fluid channel pattern.

The amount of the fluid channels formed by the respective first fluid channel pattern and the second fluid channel pattern in the pressed plate together with the flat plate is less than the amount of discrete flow channels formed by the third fluid channel pattern in the pressed plate and the flat plate. In this way, smaller area is required for the first and second longitudinal end portions, and material savings can be obtained.

According to an embodiment, each of the first and second longitudinal end portions may comprise two fluid ports, whereby e.g. a diagonal or parallel fluid flow may be arranged in a plate heat exchanger leading to an efficient heat exchange between fluids. The respective first and second longitudinal end portions may comprise the first and second fluid channel patterns leading fluid flow into the at least one fluid port and/or bypassing the at least one fluid port. The first and second fluid channel patterns may be then configured to provide a diagonal flow between the fluid ports in the first and second longitudinal end portions. Alternatively, the first and second fluid channel patterns may be configured to provide a parallel flow between the fluid ports in the first and second longitudinal end portions. Parallel flow may be more desirable than the diagonal flow in some applications.

The heat exchanger plate module according to any one of the preceding claims, wherein in the third fluid channel pattern the amount of wave shaped pressed lines, and thus the amount of fluid channels formed together with the flat plate, is from 10 to 150, or from 10 to 50, or from 12 to 20. Thereby, the heat exchanging surface can be adapted to the desired application. In the third fluid channel pattern the number of full waves in the wave shaped pressed lines may be from 8-100, or 8 to 50, or from 8 to 20, leading to a possibility to adapt the amount to be suitable for a desired application. Preferably, in the third fluid channel pattern the wave shaped pressed lines are in phase with each other, whereby equal width for each flow channel can be assured.

The plates, i.e. both or at least one of the pressed and flat plates in the module, may have a thickness of from 0.25 to 5.0 mm, or from 0.3 to 3.0 mm. By the thickness of the plates is meant the material thickness of the plates. For the pressed plate, the thickness is measured after pressing. The thickness of the plates need not to be the same, for example, the thickness of the pressed plate may the thinner or thicker than the thickness of the flat plate, but in some applications the thickness may be the same.

The pressing depth of the fluid channel patterns (FCP1; FCP2; FCP3) may be at least 0.5 mm. In this way, the alternating tops, and bottoms in the thickness direction of the plate may have a height difference of 0.5 mm, and the fluid flow channel height is therefore 0.5 mm. By adjusting the height of the channels, e.g. flow resistance in the module may be adjusted.

The above-mentioned objectives and advantages are also attained by a plate heat exchanger as defined in the appended claims. The plate heat exchanger comprises a plurality of stacked heat exchanger plate modules, suitably of the type described above. In the stack the modules are arranged such that every second plate is a pressed heat exchanger plate, and every other is a flat plate. Each of the flat and pressed heat exchanger plates has two opposite side surfaces, an extension in a longitudinal direction, transversal direction perpendicular to the longitudinal direction and thickness direction of the plate. The flat and pressed heat exchanger plates comprise

- a first longitudinal end portion comprising at least one fluid port,
- a second longitudinal end portion comprising at least one fluid port,
- an intermediate heat exchange portion arranged in between the first and second longitudinal end portions, wherein The pressed heat exchanger plate further comprises a pressed pattern forming a corrugated pattern with alternating tops and bottoms in the thickness direction of the pressed plate. The pressed pattern comprises:

- in the first and/or second longitudinal end portions, a first fluid channel pattern leading fluid flow into the at least one fluid port and/or a second fluid channel pattern bypassing the at least one fluid port,
- in the intermediate heat exchange portion, a third fluid channel pattern in fluid communication with the first fluid channel pattern and/or second fluid channel pattern, and comprising a plurality of longitudinally extending wave-shaped pressed lines configured to form discrete fluid channels in the longitudinal direction of the pressed heat exchanger plate, when the pressed heat exchanger plate is attached to the flat plate.

The flat plate may be attached to the pressed heat exchanger plate along the extension of the first fluid channel pattern, the second fluid channel pattern and the third fluid channel pattern. Thus, the flat plate of each module is attached to a pressed plate of the respective module and to a pressed plate of a neighboring module. The first, second and third fluid channel patterns may form discrete fluid channels with a contact surface along the length of the fluid channel patterns. In this way, discrete fluid tight channels are obtained in the stack, when the modules are pressed or attached to each other.

According to one example plate heat exchanger, every second of the pressed heat exchanger plates comprises in the respective first and second longitudinal end portions at least one fluid port and a first fluid channel pattern leading fluid flow into the at least one fluid port, and every other of the pressed heat exchanger plates comprises in the respective first and second longitudinal end portions at least one fluid port and a second fluid channel pattern bypassing the at least one fluid port. Thus, fluid channels for the respective cold and hot fluids may be arranged alternatingly, while large heat exchange area can be provided in a compact manner.

According to another example, every second of the pressed heat exchanger plates, which comprises in the respective first and second longitudinal end portions two fluid ports and a first fluid channel pattern leading fluid flow into one of the fluid ports and a second fluid channel pattern bypassing the other one of the fluid ports, is fixed to the flat plate with a first surface facing the flat plate, and every other of the pressed heat exchanger plates is fixed to the flat plate with a second, opposing, surface facing the flat plate. In this way, diagonal or parallel flows can be arranged in one plate module, thereby increasing the flexibility and heat exchanging capacity of the plate heat exchanger.

The plate heat exchanger may be configured so that stacks of at least two heat exchanger plate modules are arranged in parallel by attaching the modules together along two opposing longitudinal sides of the modules. Alternatively, at least two pressed patterns can be arranged in parallel on one plate, each pattern corresponding to the pressed pattern of a pressed heat exchanger plate of a module. In this way, an integrated pressed heat exchanger plate with several parallel ports may be provided in a plate heat exchanger. The amount of parallel ports in the integrated pressed heat exchanger plate, wherein each port is located in each longitudinal end portion of a pressed plate or plate pattern, can vary e.g. from 2 to 20 or even more.

The plate heat exchanger of the present disclosure is thus suitably a recuperative heat exchanger, in which separate flow paths are arranged for each fluid.

The fluid ports may be connected to an external fluid connector.

The plate heat exchanger may be a fusion-bonded, brazed, welded, diffusion-welded or a gasketed heat exchanger.

The plate heat exchanger may be configured for heat exchange between two gases. According to a variant, the plate heat exchanger is configured for high pressure applications.

According to a further aspect of the invention, the present invention relates to a process for the production of a plate heat exchanger as described above, the process comprising the steps of:

- cutting a sheet metal material so as to provide two or more metallic plates having an extension in a longitudinal (l) direction, transversal (t) direction perpendicular to the longitudinal direction and thickness direction (d) of the plate,
- pressing at least one of the metallic plates in a pressing tool, whereby the pressing tool is configured to provide a pressed pattern P to the heat exchanger plate,
- providing a flat plate having corresponding outer shape and dimension as the pressed plate in the longitudinal and transversal direction,
- providing a heat exchanger plate module comprising a pressed plate and a flat plate
- assembling a stack of heat exchanger plate modules such that every second plate is a pressed heat exchanger plate (201), and every other is a flat plate (201'),
- joining the modules together to provide a plate heat exchanger comprising the stack of heat exchanger modules.

The present invention will become apparent from the detailed description given below. The detailed description and specific examples disclose the invention by way of illustration only. Those skilled in the art understand from guidance in the detailed description that changes, and modifications may be made within the scope of the invention defined in the appended claims.

BRIEF DESCRIPTIONS OF THE DRAWINGS

The above objectives, as well as additional objectives, features and advantages of the present invention, will be more fully appreciated by reference to the following illustrative and non-limiting detailed description of example embodiments of the present invention, when taken in conjunction with the accompanying drawings.

Figure 1B:
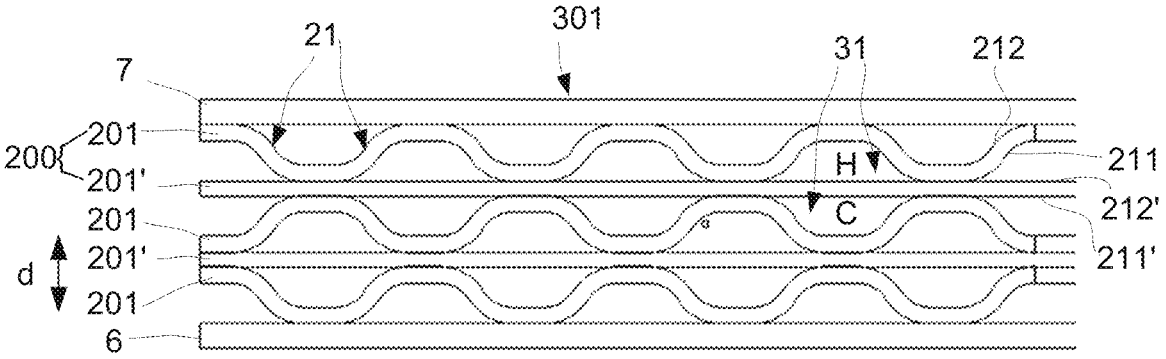

FIG. 1*a* shows schematically an example of a plate heat exchanger comprising a stack of heat exchanger plates in a side view;

FIG. 1*b* shows schematically an enlarged cross section from above of a stack of plates in a plate heat exchanger, which may be of the type shown in FIG. 1*a;*

Figure 2:
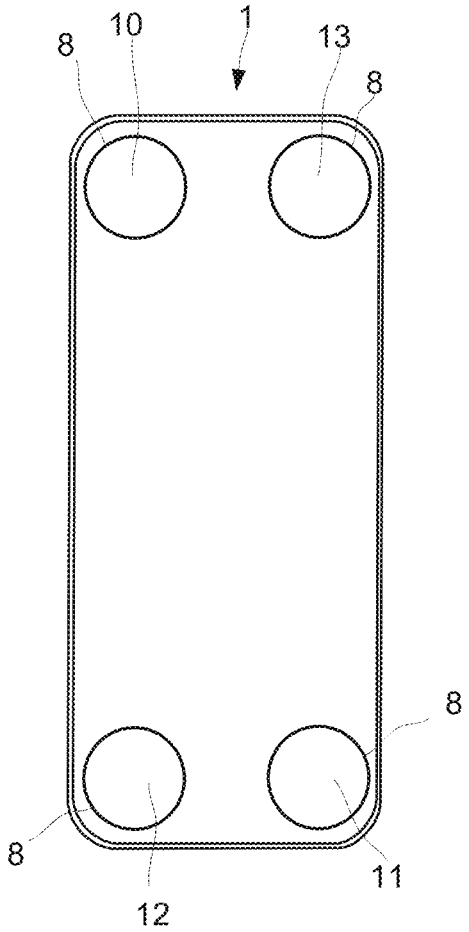

FIG. 2 shows schematically in a front view an end plate suitable for a heat exchanger shown in FIG. 1*a;*

Figure 3A:
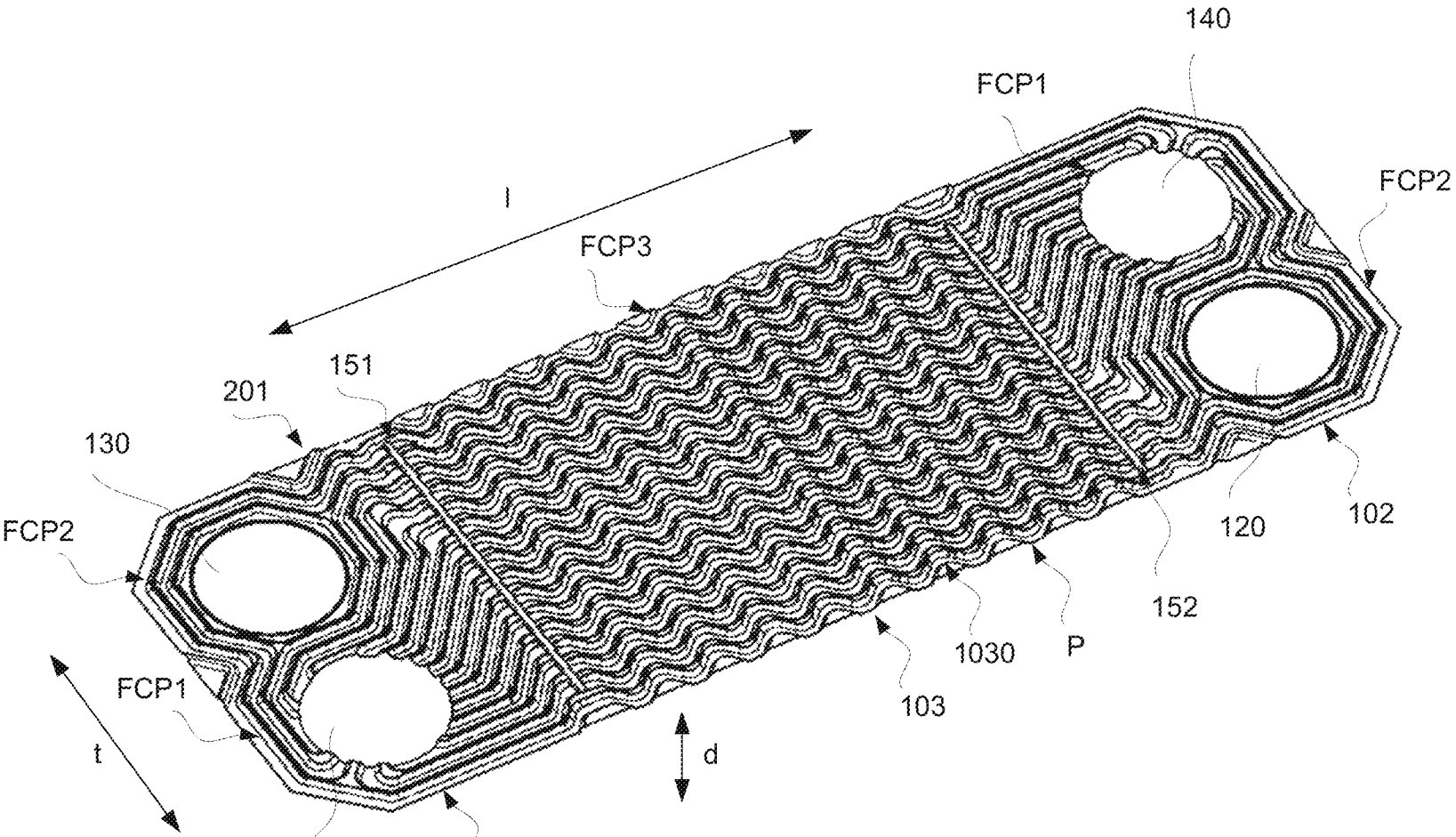

FIG. 3*a* shows a heat exchanger plate with four integrated ports according to an embodiment of the present disclosure.

Figure 3B:
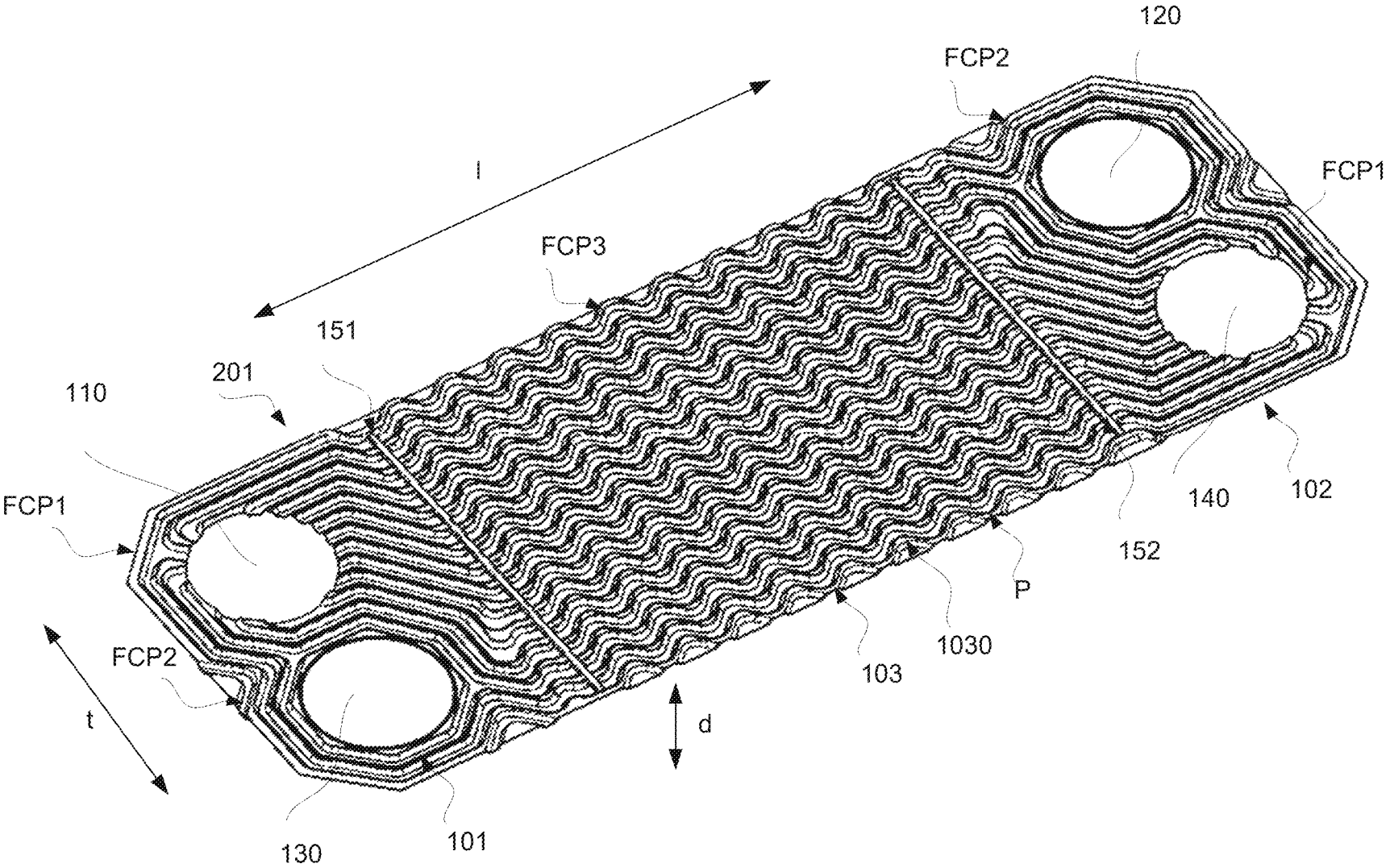

FIG. 3*b* shows a mirror-imaged heat exchanger plate of FIG. 3*a.*

Figure 4A:
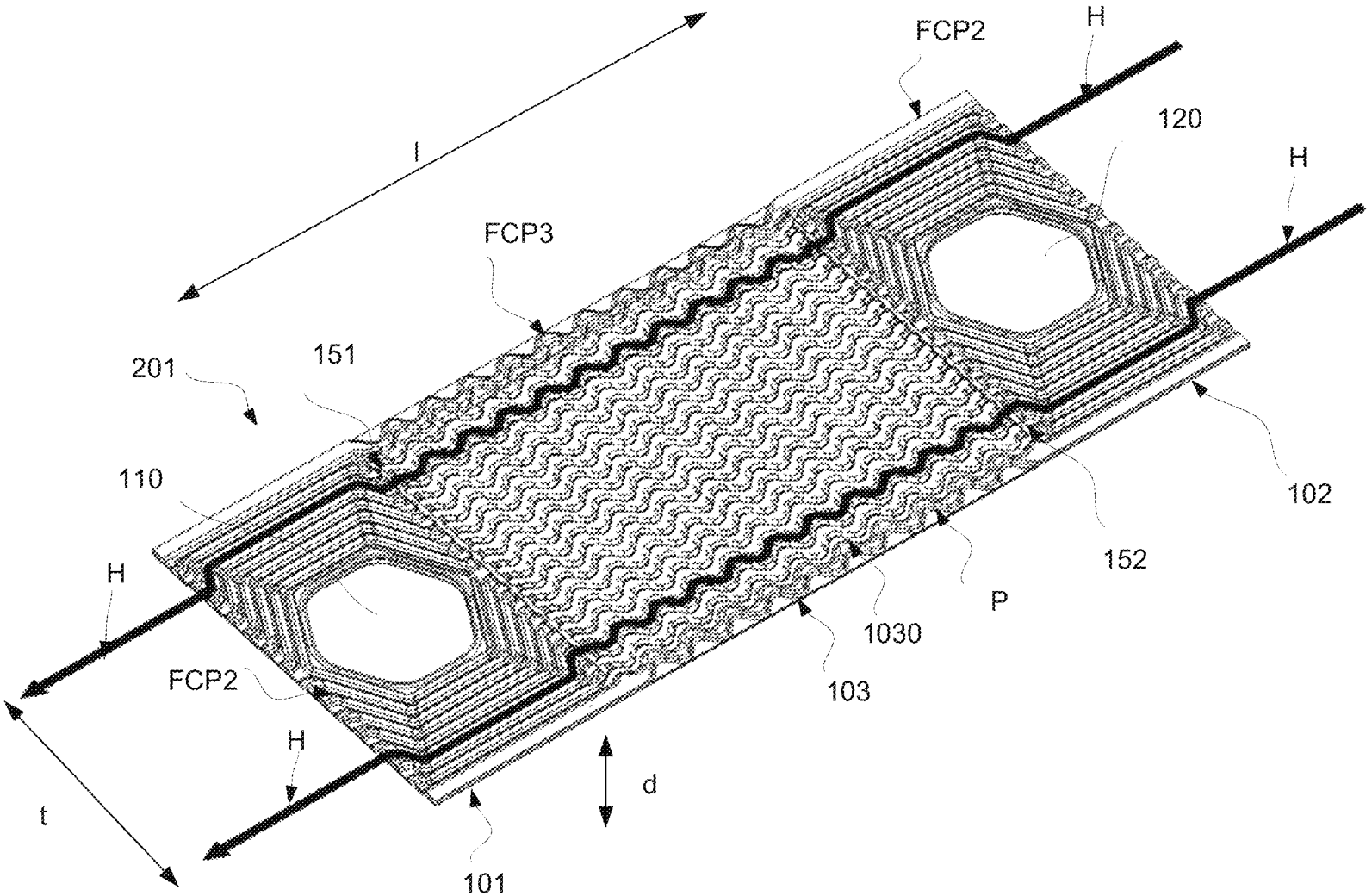

FIG. 4*a* shows another embodiment of a heat exchanger plate according to the present disclosure, wherein the plate corresponds to a first plate type and comprises two integrated ports and a flow channel pattern bypassing the ports.

Figure 4B:
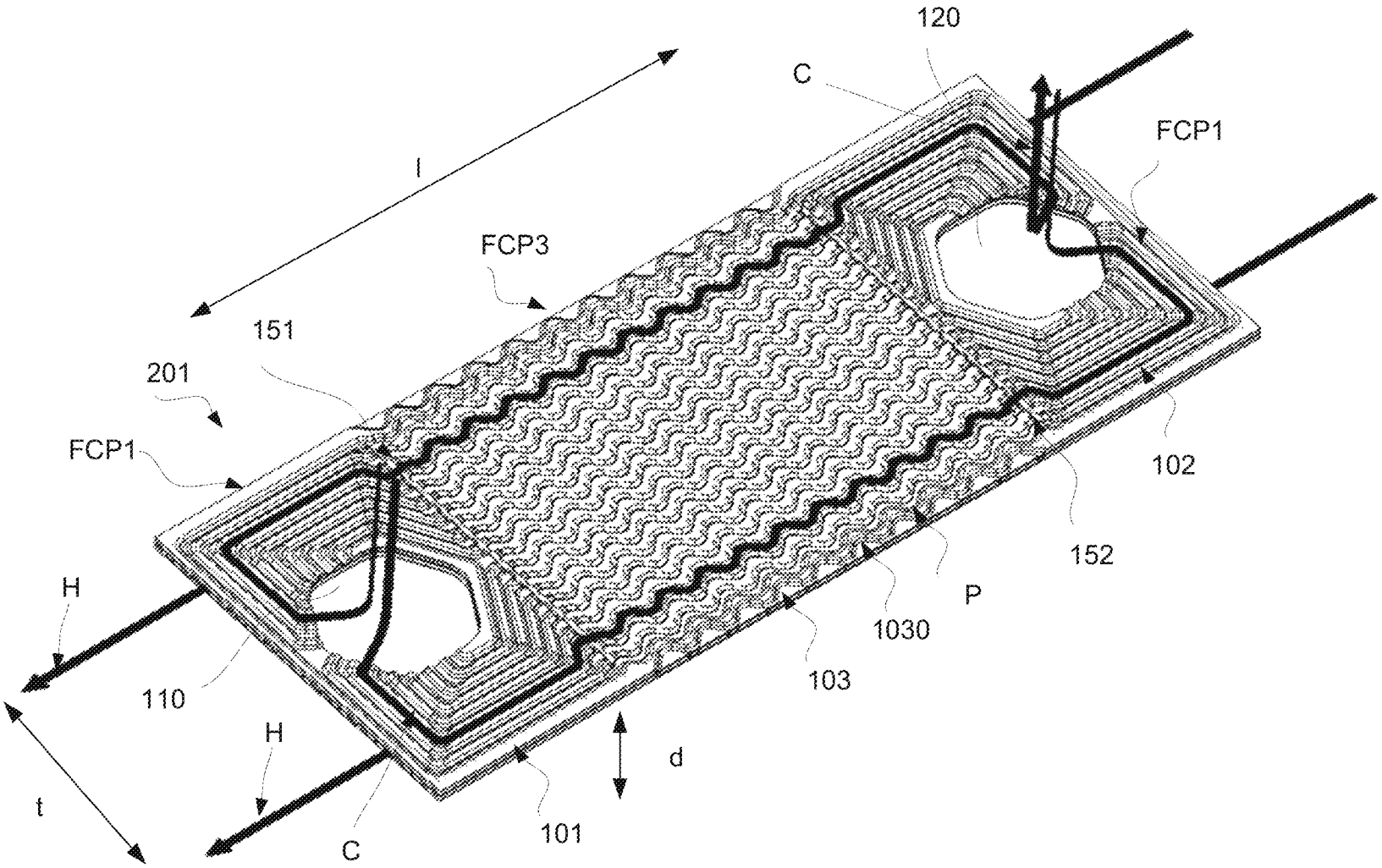

FIG. 4*b* shows a second plate type from above for an embodiment of a heat exchanger plate module according to the present disclosure, wherein the module comprises the plate of FIG. 4*a* and a flat plate sandwiched between the plate of FIG. 4*a* and the plate topmost shown in FIG. 4*b*, the plate comprising two ports and a flow channel pattern leading a fluid flow into the ports in a so-called "U-flow".

Figure 5:
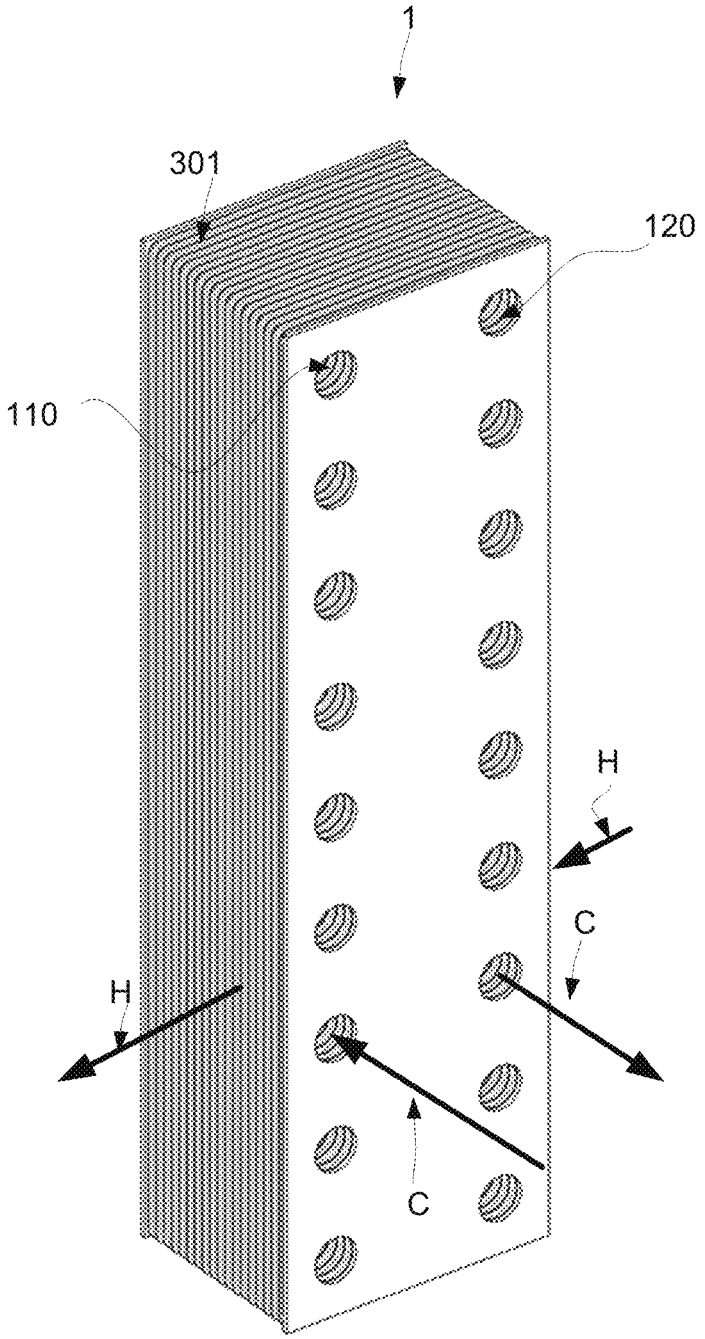

FIG. 5 shows an example of a plate heat exchanger configured for the so-called "U-flow" for the cold fluid, wherein the heat exchanger comprises a stack of heat exchanger plates comprising nine parallel plate stacks comprising the module of FIG. 4*b*, or a stack of wide plates, wherein each wide plate contains nine parallel plate patterns of the type illustrated in FIG. 4*a* or topmost in FIG. 4*b*.

Figure 6A:
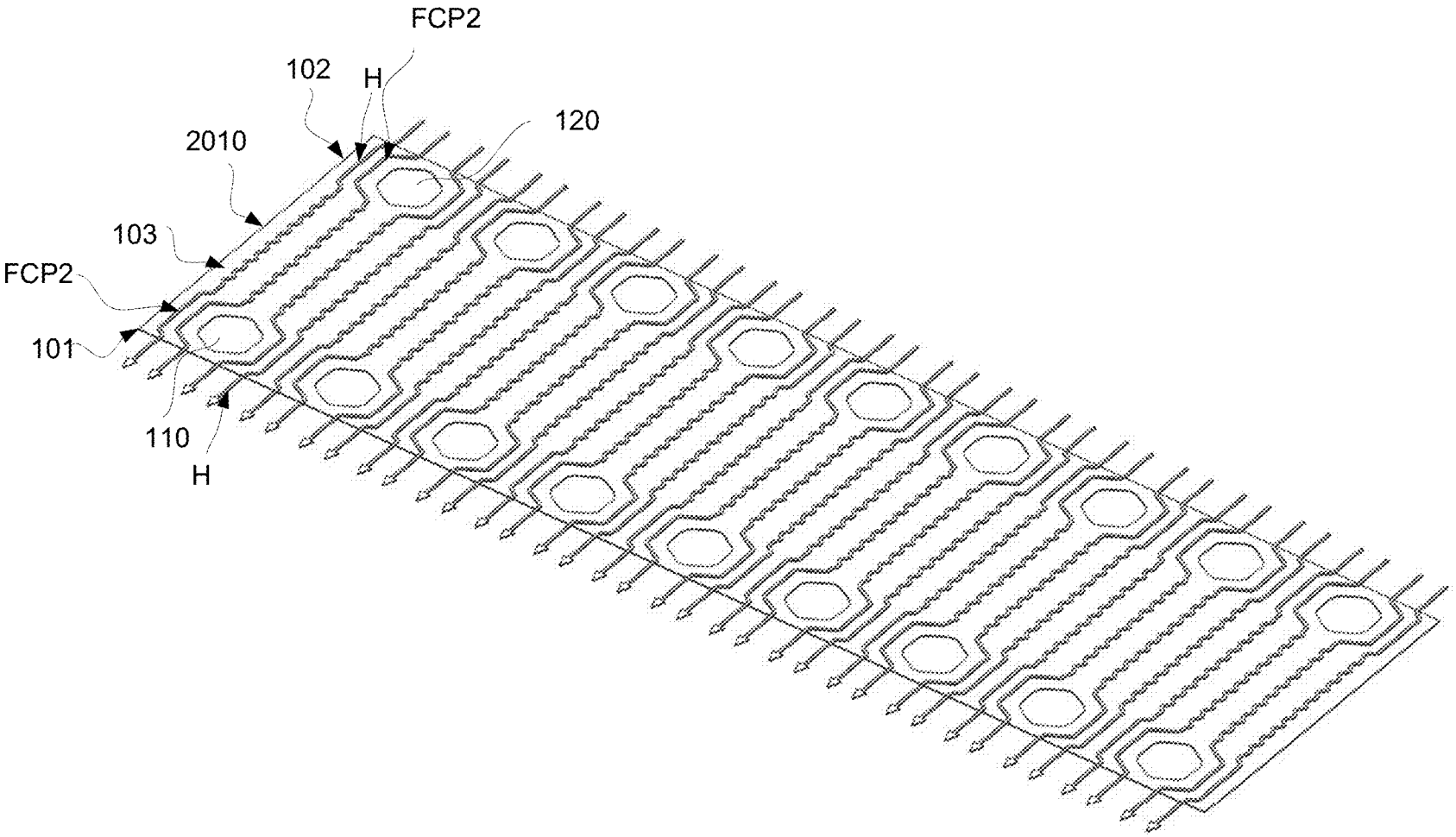

FIG. 6*a* shows schematically fluid flows in a wide plate comprising nine parallelly arranged plate patterns, wherein one of the plate patterns corresponds to the plate shown in FIG. 4*a.*

Figure 6B:
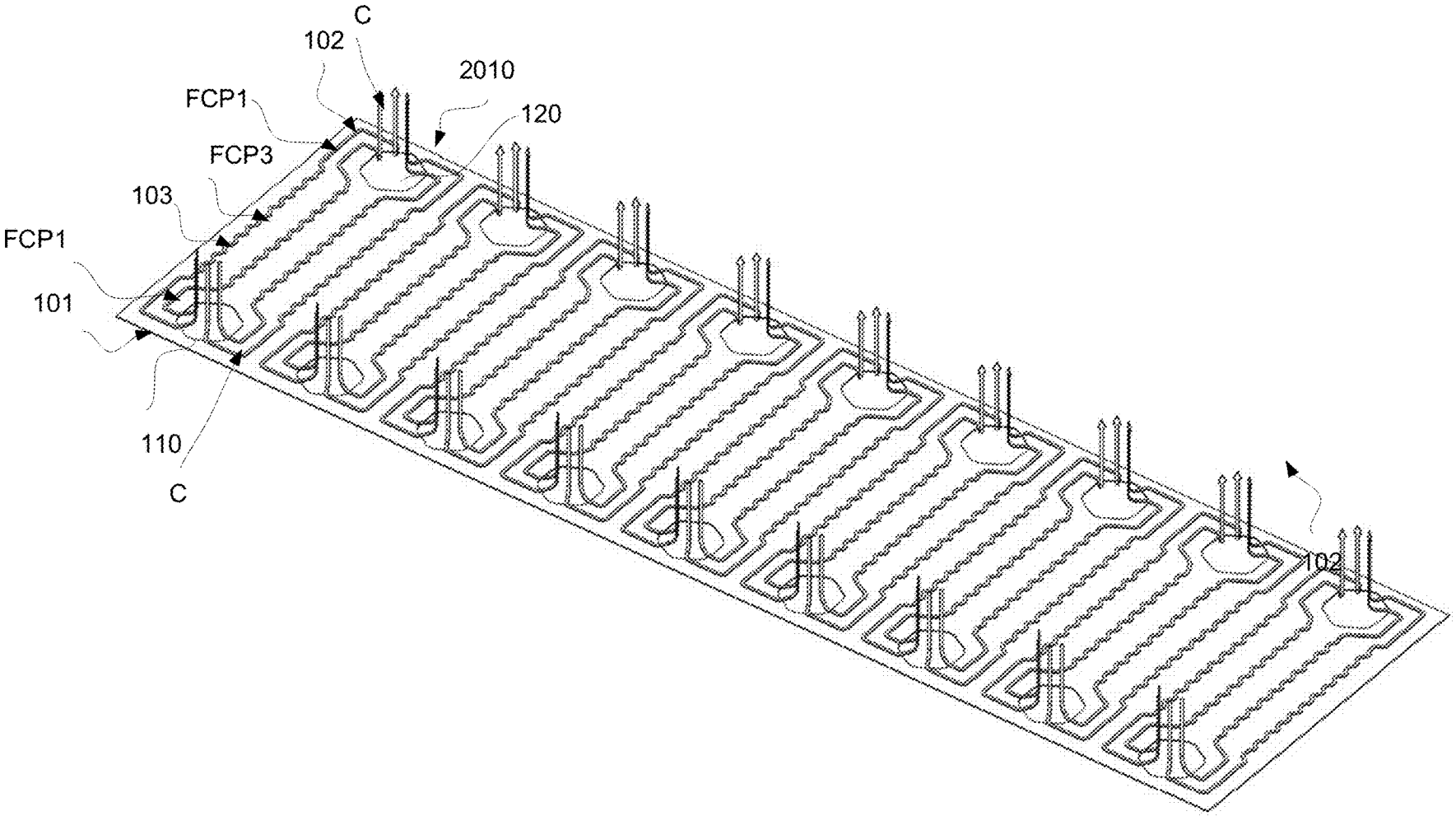

FIG. 6*b* shows schematically fluid flows in a wide plate comprising nine parallelly arranged plate patterns, wherein one of the plate patterns corresponds to the plate shown in FIG. 4*b.*

Figure 7A:
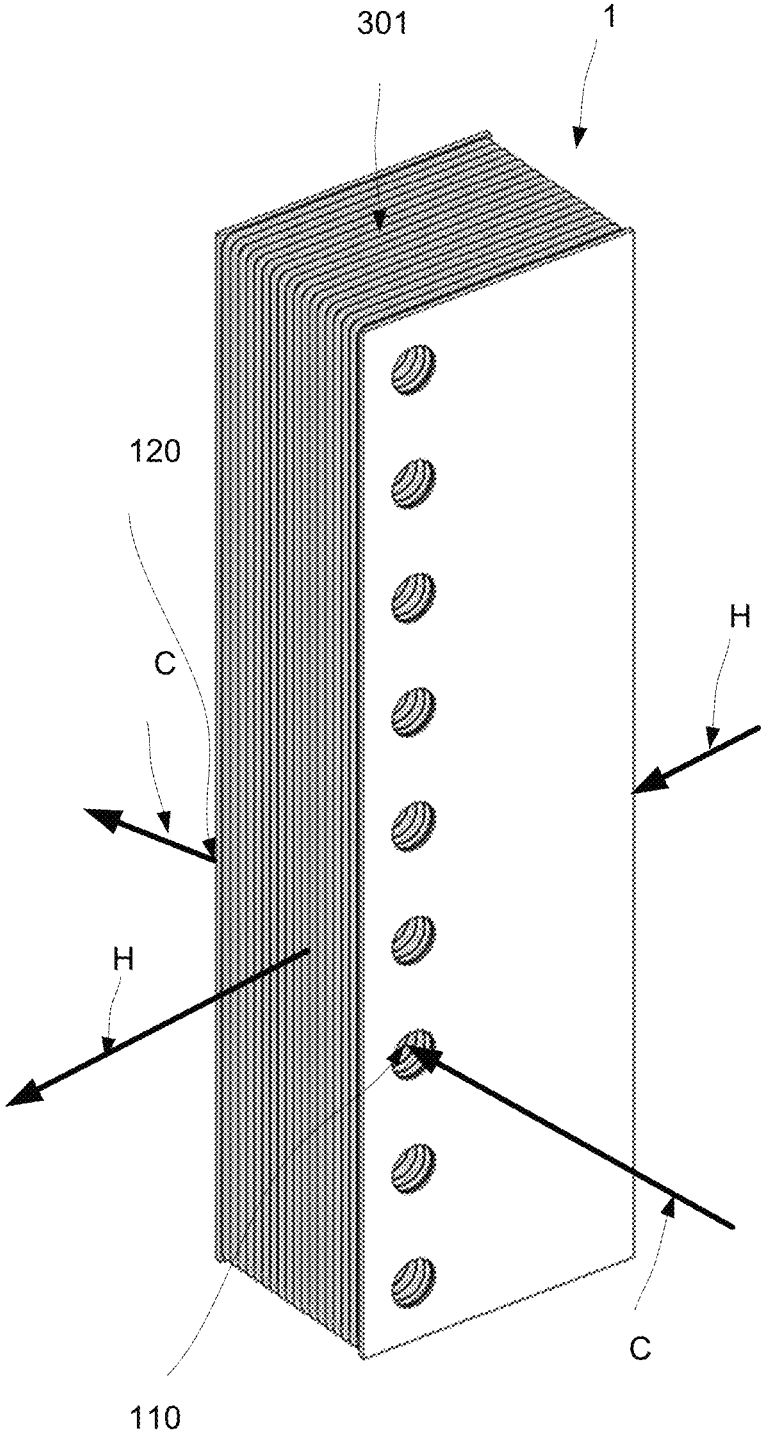

FIG. 7*a* shows a plate heat exchanger with a stack of plates each having nine parallelly arranged plate patterns, the plates arranged in a module and arranged for a so-called "Z-flow" for the cold flow.

Figure 7B:
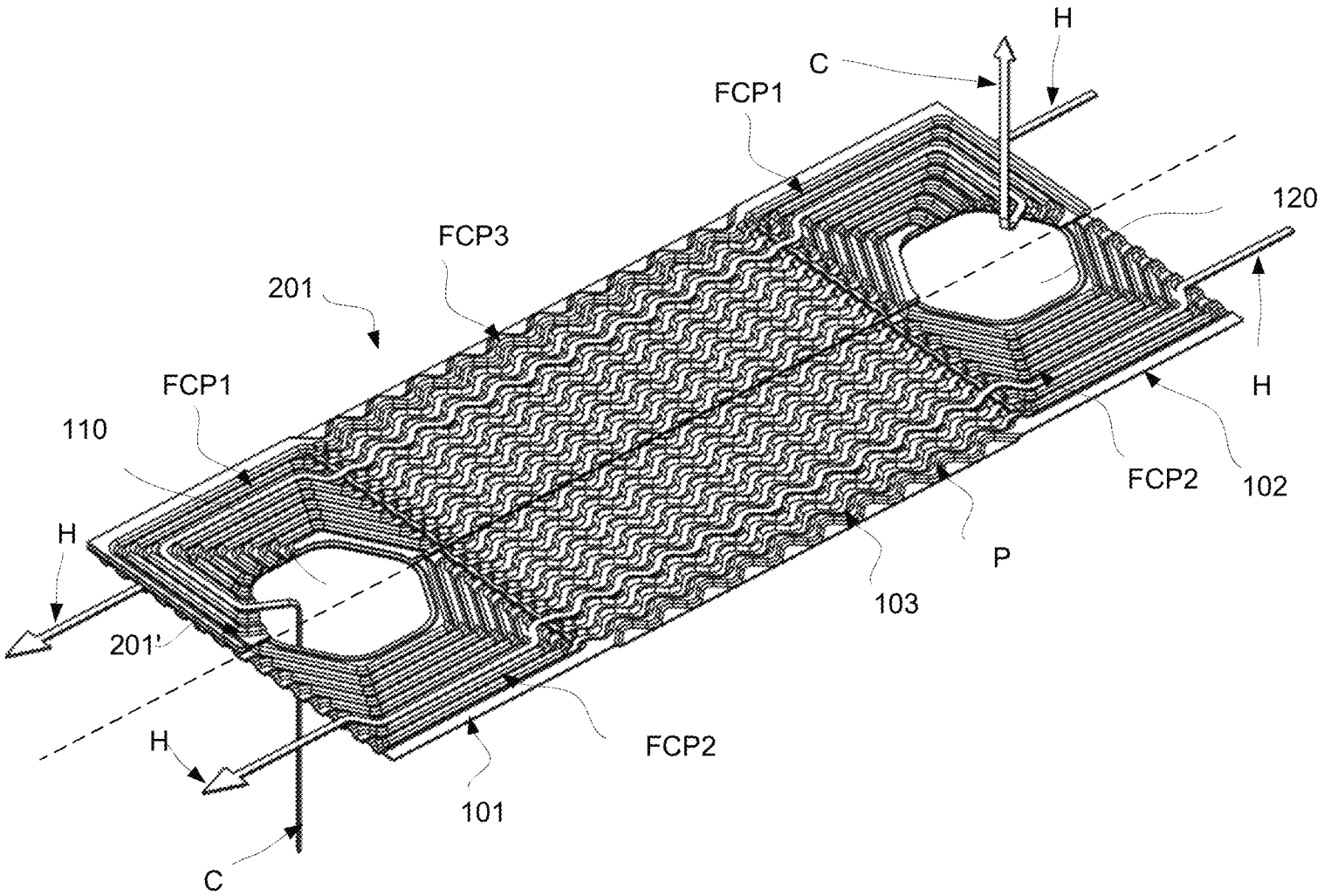

FIG. 7*b* shows the flows arranged in one parallel plate of FIG. 7*a* or one parallel plate pattern corresponding to the pattern of FIG. 7*a* arranged in part of a wide plate.

Figure 8A:
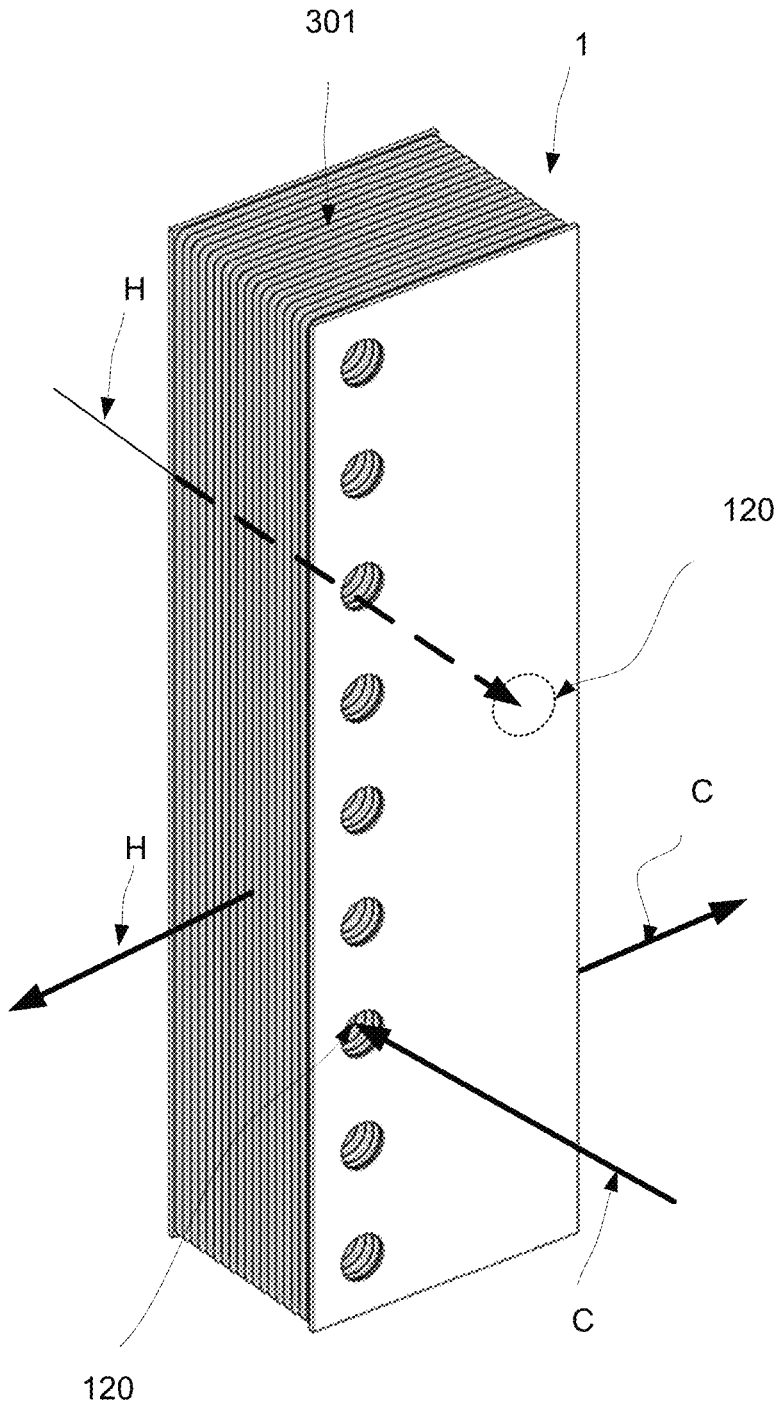

FIG. 8*a* shows a plate heat exchanger with a stack of plates each having nine parallelly arranged plate patterns and arranged for a so called "L-flow" for both the cold and the hot flows.

Figure 8B:
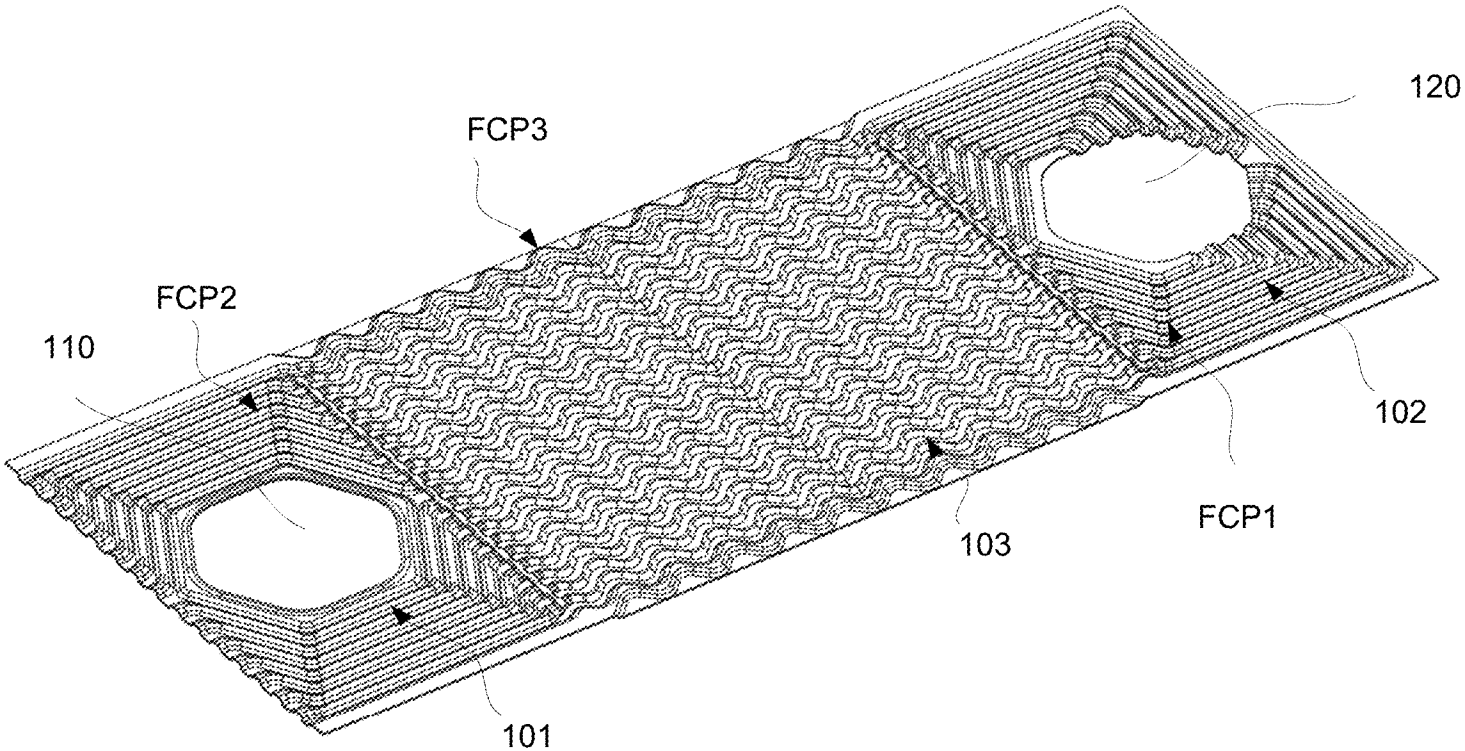

FIG. 8*b* shows a further embodiment of a heat exchanger plate according to the present disclosure, wherein the plate comprises two integrated ports and two flow channel patterns, wherein one leads the flow in to the port and one bypasses the port, and wherein the plate or plate pattern is suitable for the plate heat exchanger configured for the "L-flow" as shown in FIG. 8*a.*

DETAILED DESCRIPTION

Today's process technologies often involve heat exchangers for improving the energy efficiency of processes. One type of commonly used heat exchangers is so called shell-and-tube heat exchangers, which may be used for example as coolers. In these coolers incoming gas may be used as coolant. Although they may be effective and tolerate fluids with high pressure, they are often space demanding. Such heat exchangers are commonly used for example in ammonia converters between catalyst beds. Converters may be big pressure vessels, containing two to three catalyst beds and two to three heat exchangers, designed for around 200 bar. But they are often inside the pressure vessel and with little pressure difference between the hot and the cold gas. More compact heat exchangers would free up converter vessel volume, allowing more catalyst and thus a capacity increase while not requiring larger vessels. Furthermore, due to demands on higher energy efficiency for example in connection with combustion engines, there is an increasing need to utilize the combustion energy in a recuperative manner, e.g. to pre-heat an incoming gas with an outgoing gas. At the same time, high-pressure process technology environments may be demanding with high temperatures and large amounts of dust and other particles and corrosive gases, which require robust constructions which tolerate the prevailing conditions. Thus, there is a great need for compact, robust and efficient heat exchanger technology usable in demanding high-pressure conditions. Therefore, it is an objective with the present invention to provide heat exchanger technology which responds to these needs.

It has been found that the objectives above are achieved by a plate heat exchanger according to the present invention, which will now be described with reference to the accompanying drawings showing examples of the invention. The invention may, however, be embodied in other forms and should not be construed as limited to the herein disclosed example embodiments. The disclosed embodiments are provided to fully convey the scope of the invention to the skilled person.

FIG. 1*a* shows schematically an example of a plate heat exchanger 1, which comprises a stack 301 of stacked heat-exchanger modules 200 comprising pressed plates 201 and flat plates 201'. The plate heat exchanger 1 is aimed for heat exchange between two fluid media of different temperatures, one referred to as "cold" (C) fluid and the other referred to as "hot" (H) fluid. The cold fluid has a lower temperature than the hot fluid. The heat exchange may be performed for different purposes, for example heating, cooling, heat recovery, evaporation and condensation. The fluid may be a gas or liquid, such as water. According to a variant, the plate heat exchanger is used in the production of ammonia, which requires the use of high fluid pressures, but is not limited thereto. The plate heat exchanger of the present disclosure is configured for high pressures and is therefore able to withstand high pressures/pressure differences of fluids during e.g. ammonia production.

The plate heat exchanger 1 plate stack 301 comprises a plurality of heat exchanger plates 201, 201' stacked on top of each other by alternating pressed plates 201 and flat plates 201' in relation to each other, and successively in such a way that they form the plate stack 301 with every other plate being a pressed plate and every other being a flat plate. The heat exchanger plates 201 have a pressed design according to the present invention, which will be described more in detail below. The flat plates do not comprise a pressed flow channel pattern, but do not need to be completely flat, i.e. the flat plates may comprise minor bends. The plate stack 301 is provided between a first end plate 6 that is arranged on a first side of the plate stack 301 and a second end plate 7 that is arranged on a second side of the plate stack 301. The end plates 6, 7 may have the same outer peripheral shape as the heat exchange plates 201, 201' in the plate stack 301 but may be slightly thicker for providing increased mechanical protection against external forces. The outer shape of the plates in the stack is rectangular with rounded corners, but other shapes, e.g. rectangular with angled corners (i.e. with eight corners, see e.g. FIG. 3*a*) or sharp corners are possible.

The pressed plates 201 and the flat plates 201' of each module 200 may be permanently joined to each other in the plate stack 301. In the stack 301 the modules 200 with alternating pressed plates 201 and the flat plates 201' form alternatingly first and second flow channels or paths for a respective first fluid and a second fluid. The flow channels are formed on a respective side of the flat plates 201' when the pressed plates 201 are attached to a respective side surface of the flat plates 201'.

The plate heat exchanger 1 may comprise a first fluid port 10, which may be an inlet, and a second fluid port 11, which may be an outlet. The first fluid port 10 may function as an inlet and receives the first fluid and leads the first fluid to the first flow path between the plates in the plate stack 301. The second fluid port 11 functioning as an outlet receives the first fluid from the first flow path and allows the fluid to exit the plate heat exchanger 1. The plate heat exchanger 1 may include a third fluid port 12 functioning as an inlet and a fourth fluid port 13 functioning as an outlet as shown in the example of FIG. 2. The third fluid port 12 receives the second fluid and leads the second fluid to the second flow path between the plates. The fourth fluid port 13 receives the second fluid from the second flow path and allows the second fluid to exit the plate heat exchanger 1.

Connectors 8 can in some embodiments be connected to each of the ports functioning as inlets and the outlets, and each connector 8 may have the form a pipe. Fluid lines for the two fluids may then be connected to the plate heat exchanger 1 via the connectors 8. Any suitable technique may be used for accomplishing such connection, and the connectors 8 are typically made of the same material as the plates in the plate stack 301. Inlets and outlets for one of the fluids me be reversed, such that there is a co-current flow of the fluids, instead of a counter flow as illustrated. However, connectors of this type are not necessary in all embodiments of the present invention.

The present invention relates according to one aspect to a heat exchanger plate module 200 comprising a flat plate 201' and a pressed heat exchanger plate 201, which are configured to be attached to each other as shown schematically by FIG. 1*b* in a cut view of an intermediate portion of the plates, i.e. in between the ports 10, 13; 11, 12 from a top side of the heat exchanger stack 301. The plates may be for example permanently attached to each other and may be brazed, fusion-bonded, or welded together. From FIG. 1*b* it can be seen that three pressed plates 201 with a pressed pattern comprising alternatingly tops T and bottoms B in the thickness direction d of the plate, form a wave-shaped outer contour or fins 21 in the thickness direction d. These fins 21 together with the flat plates 201' and/or end or side plates 6 and 7 form discrete flow channels for the respective hot and cold flows in the opposite sides of the flat plates 201'. Additionally, the fins 21, only two of which are provided with a reference sign, provide an increased heat exchanging surface for the plate heat exchanger.

Each of the heat exchanger modules 200 are arranged such that between two mirror-imaged pressed plates 201, there is a flat plate 201' attached to the respective surface of the pressed plates 201. The pressed plates 201 comprise the above-mentioned fins 21, which are formed when a wave-shaped flow channel pattern P is pressed to the pressed plates 201. In this way, the fins 21 of the plates 201 together with the flat plates 201' form the discrete fluid channels 31, in which the hot (H) or cold (C) fluid, such as gas, can flow. The height of the channels 31, i.e. the extension in the thickness direction d of the plate, may be adapted to the type of fluid and pressure in a process. The higher the channels are, the larger is the heat exchange area –. The height of the channels may additionally influence the pressure drop for the flow in the channels. Additionally, when manufacturing the plates by pressing, the strength properties of the channels may be affected by the chosen height, i.e. the higher the channels are for a given plate thickness, the more the strength properties of the plates are affected. The height of the channels may be for example from 0.5 mm to 10 mm, such as 1-5 mm, for example about 1.5 mm. The metallic plates, i.e. both flat and pressed plates, may generally have an initial thickness of about 0.1 to 1.0 mm, i.e. before pressing the pattern P to the plates. The thickness of the plate is suitably unitary throughout the whole pressed heat exchanger plate. Thereby, attachment to the flat plate may be done in a controlled manner. Additionally, the height of the channels is suitably unitary throughout the whole pressed heat exchanger plate. However, in some embodiments, the height of the channels may vary. Each of the flat plate 201' and the pressed heat exchanger plate 201 have two opposite side surfaces 211', 212' and 211, 212, respectively.

FIGS. 3*a* and 3*b* show a pressed heat exchanger plate 201 according to an embodiment of the present disclosure more in detail. The plate 201 has an extension in a longitudinal (I) direction, transversal (t) direction perpendicular to the longitudinal direction, and thickness direction (d) of the plate. The pressed heat exchanger plate 201 shown in FIG. 3*a*-3*b* is configured to be attached to a flat plate 201' (see FIG. 1*b*), which has substantially the same outer shape in the longitudinal direction I and transversal direction t as the pressed plate 201. Each of the flat plate 201' and pressed heat exchanger plate 201 in the module 200 comprises a first longitudinal end portion 101 comprising two fluid ports 110, 130, a second longitudinal end portion 102 comprising two fluid ports 120, 140 and an intermediate heat exchange portion 103 arranged in between the first and second longitudinal end portions 101, 102. The pressed heat exchanger plate 201 further comprises a pressed corrugated pattern P extending in the plane of the transversal and longitudinal extension and forming the fins 21 with tops and bottoms in the thickness direction (d) of the plate, as illustrated in FIG. 1*b*.

In the embodiment shown in FIG. 3*a*-3*b*, the pressed pattern P comprises in the respective first and second longitudinal end portions 101 and 102, a first fluid channel pattern FCP1 leading fluid flow into a respective fluid port 110, 140 and a second fluid channel pattern FCP2 bypassing a respective fluid port 130, 120. In this way, the pressed heat exchanger plate comprises the total of four ports, i.e. two in each longitudinal end portion 101 and 102. By providing two fluid ports in the respective longitudinal end portions, wherein the fluid is lead to one port 110, 140 and the other one 130, 120 is bypassed, the temperature range and gradient in the metal plate will be smaller, which results in lower thermal stress and to better fatigue strength. As can be seen from the FIG. 3*a*-3*b*, the flow into the ports is arranged in a diagonal way. In this way it is possible to provide a favorable flow distribution, whereby for example thermal stress of the plate can be further decreased at high temperatures. However, the ports and flow patterns may alternatively be arranged so that the fluid flows in a parallel manner.

As shown in connection with FIG. 3*a*-3*b*, the pressed heat exchanger plate 201 comprises in the intermediate heat exchange portion 103 a third fluid channel pattern FCP3, which is arranged in fluid communication with the first fluid channel pattern FCP1 and the second fluid channel pattern FCP2. The third fluid channel pattern FCP3 comprises a plurality of longitudinally extending wave-shaped pressed lines 1030 configured to form the fins 21 in the thickness direction d.

By "pressed line" is meant in this disclosure a distinct, elongated, narrow ridge, beam or track pressed to a heat exchanger plate, whereby the pressed line has an extension in the longitudinal, transversal and thickness direction, and whereby the extension in the longitudinal direction is larger than the extension in the transversal and thickness direction. By "wave-shaped" is meant a shape resembling sinusoidal curve. The amplitude and the wavelength may be the same along one pressed line or may vary within one pressed line. The pressed line suitably has curved edges in all directions (longitudinal, transversal and depth) and thus no sharp edges, although sharp edges may occur in some embodiments.

The fins 21 formed by the pressed wave-shaped lines 1030 in turn form discrete fluid channels 31 in the longitudinal direction (I) of the heat exchanger plate, when the pressed heat exchanger plate 201 is attached to the flat plate 201' as shown in FIG. 1*b*. The third fluid channel pattern FCP3 forms a main part of the heat exchanging surface in the intermediate portion 103 of the plate 201. The wave-shape of the pressed lines 1030 extends mainly in the plane of the longitudinal direction I and transversal direction t. In the thickness direction d, the height of the wave shaped pressed lines, and thus the formed discrete channels 31, have substantially the same extension throughout the whole length of the third fluid channel pattern FCP3. In this way, the attachment of the flat plate 201' to the pressed plate 201 in the module 200 can be made in a fluid tight manner. Additionally, a final outer shape of a heat exchanger will be consistent in all directions. The flat plate 201' may be attached to the pressed heat exchanger plate 201 along the extension of the whole third fluid channel pattern FCP3, whereby discrete channels are formed and a risk for leakage between the discrete channels is minimized.

In FIG. 4*a*-4*b* another embodiment of the pressed heat exchanger plate 201 according to the present disclosure is shown. Instead of four ports in the respective pressed plates 201 and flat plates 201' of each module 200, there are only two ports, one in the respective end portion 101, 102 of the plates. Additionally, as shown in FIG. 4*a*-4*b*, each plate may have either a first fluid channel pattern FCP1 or the second fluid channel pattern FCP2 in both first and the second end portions 101, 102. In a variant however, each plate may have the first fluid channel pattern FCP1 in the first end portion and the second fluid channel pattern FCP2 in the second end portion.

In FIG. 4*a* a type of a pressed heat exchanger plate 201 is shown having the second fluid channel pattern FCP2 in the respective end portions 101, 102 by-passing the ports 110, 120. In FIG. 4*b* a type of a pressed heat exchanger plate 201 is shown having the first fluid channel pattern FCP1 in the respective end portions 101, 102 leading the flow into the ports 110, 120. The flow by-passing the ports 110, 120 is in this example hot (H) and the flow lead through the ports 110, 120 is in this example cold (C).

FIG. 5 shows an embodiment of a heat exchanger in which the heat exchanger plate modules of FIG. 4*a*-4*b* can be used but pressed into one large, integrated heat exchanger plate, and FIG. 6*a*-6*b* show a fluid flow in the respective integrated wide plate.

Reference is made to FIG. 4*a*, in which a first type of the pressed heat exchanger plate 201 according to the two-port embodiment of the present disclosure is shown in more detail. Each plate 201 has an extension in a longitudinal (I) direction, transversal (t) direction perpendicular to the longitudinal direction, and thickness direction (d) of the plate. In the embodiment shown in FIG. 4*a*, the pressed pattern P comprises in the respective first and second longitudinal end portions 101 and 102, a second fluid channel pattern FCP2 bypassing a respective fluid port 110, 120. In the embodiment shown in FIG. 4*b*, the pressed pattern P comprises in the respective first and second longitudinal end portions 101 and 102, a first fluid channel pattern FCP1 leading the fluid into a respective fluid port 110, 120. Further in the embodiment shown in FIG. 4*a*-4*b*, the pressed heat exchanger plate 201 comprises in the intermediate heat exchange portion 103 a third fluid channel pattern FCP3, which is arranged in fluid communication with the first fluid channel pattern FCP1 of the plate shown in FIG. 4*a* or a second fluid channel pattern FCP2 of the plate shown in FIG. 4*b*.

In the same manner as in connection with the embodiment shown in FIG. 3*a*-3*d*, the third fluid channel pattern FCP3 in the embodiments of FIG. 4*a*-4*b* comprises a plurality of longitudinally extending wave-shaped pressed lines 1030 configured to form fins which in turn form discrete fluid channels in the longitudinal direction (I) of the heat exchanger plate, when the pressed heat exchanger plate is attached to the flat plate as shown in FIG. 1*b*. The third fluid channel pattern FCP3 forms a main part of the heat exchanging surface of the plate 201. The wave-shape extends mainly in the plane of the longitudinal direction I and transversal direction t. In the thickness direction d, the height of the wave shaped pressed lines has substantially the same extension throughout the whole third fluid channel pattern FCP3. In this way, the attachment of the flat plate 201' can be made in a fluid tight manner and so that the final outer shape of a heat exchanger will be consistent.

In all the variants of the pressed plates of the present disclosure, the first fluid channel pattern FCP1 and/or the second fluid channel pattern FCP2 may form a discontinuous pattern with the third fluid channel pattern FCP3 by using an interrupting portion 151 and 152, respectively, between the first and/or the second fluid channel patterns FCP1 and FCP2, respectively, and the third fluid channel pattern FCP3, as shown by FIG. 3*a*-3*b* and FIG. 4*a*-4*b*. By using the interrupting portions 151 and 152, it is possible to provide a simple construction in which a different number of fluid channels in the intermediate portion 103 can be used than in the end portions 101, 102. According to a variant, the number of fluid channels formed by the respective first fluid channel pattern FCP1 and the second fluid channel pattern FCP2 is less than the amount of discrete flow channels formed by the third fluid channel pattern FCP3. In this way, it is possible to provide a generally smaller heat exchanger plate and thus provide a more compact heat exchanger structure and additionally save material costs, while continuous flow of the fluid is possible.

The flat plate 201' (see FIG. 1*b*) may be attached to the pressed heat exchanger plate 201 along the extension of the whole third fluid channel pattern FCP3, whereby discrete channels are formed and a risk for leakage between the respective hot and cold fluids is minimized.

Generally, the amount of wave-shaped pressed lines 1030 in the third fluid channel pattern FCP3 may be from 10 to 150, or from 10 to 50, or from 12 to 20. The number of the pressed lines affects the width of the discrete channels in the transversal direction t of the plate. The width in turn affects for example the strength of the pressed plate and the pressure drop obtained for the fluids. The number of the pressed wave-shaped lines may be adapted to the process parameters including the fluid, pressures and temperatures in the process. Furthermore, in the third fluid channel pattern FCP3 the number of full waves in the wave-shaped pressed lines may vary depending on the size of the plate and may be from 8-100, or 8 to 50, or from 8 to 20. Additionally, in the third fluid channel pattern FCP3 the wave-shaped pressed lines may be in phase with each other, whereby uniform flow in each discrete channel can be provided.

Additionally, in accordance with the two-port embodiment shown in FIG. 4*a*-4*b*, both the pressed heat exchanger plate 201 and the flat heat exchanger plate 201' have substantially the same outer shape in the longitudinal and transversal direction I, t. Each of the flat and pressed heat exchanger plates in the module may comprise a first longitudinal end portion 101 comprising a fluid port 110, a second longitudinal end portion 102 comprising a fluid port 120 and an intermediate heat exchange portion 103 arranged in between the first and second longitudinal end portions 101, 102. The pressed heat exchanger plate 201 further comprises a pressed corrugated pattern P forming fins 21 with tops and bottoms in the thickness direction (d) of the plate, as illustrated in FIG. 1*b*.

Generally, both the pressed heat exchanger plates 201 and the flat plates 201' may have a thickness of from 0.25 to 5.0 mm, or from 0.3 to 3.0 mm. The thickness of the pressed heat exchanger plates 201 may be the same or may be different for the cold/hot side. The thickness of the flat plates 201' is also preferably the same, except for the end plates 6, 7 shown in FIGS. 1*a* and 1*b*, which may be thicker. The pressed heat exchanger plates 201 may have the same thickness or they may initially have the same thickness as the flat plates 201'. However, during the pressing operation, the thickness of the pressed plate 201 may be influenced, whereby the final thickness of the pressed plate 201 may be smaller than the thickness of the flat plate 201'. In some cases, it may also be possible that the pressed plates 201 are thicker or thinner than the flat plates 201'. Generally, the material for the pressed plates 201 and the flat plates 201' may be any suitable and commonly used, such as stainless steel, aluminium, copper, nickel, tantalum, titanium or alloys thereof, but are not limited thereto. The materials may be the same or different for the pressed plates 201 and the flat plates 201'.

The present disclosure also relates to a plate heat exchanger 1 comprising a plurality of stacked heat exchanger plate modules 200, which may be of the type described above. In the stack 301 the modules 200 comprise as every second plate a pressed heat exchanger plate 201 and every other plate a flat plate 201', as schematically illustrated in FIG. 1*b*. Each of the flat and pressed heat exchanger plates has two opposite side surfaces, an extension in a longitudinal (I) direction, transversal (t) direction perpendicular to the longitudinal direction, and thickness direction (d) of the plate, as explained above.

The plate heat exchanger may be configured for heat exchanger modules 200 comprising pressed plates 201 having the structure as described above. Each of the flat heat exchanger plates 201' and pressed heat exchanger plates 201 may comprise a first longitudinal end portion 101 comprising at least one fluid port 110, a second longitudinal end portion 102 comprising at least one fluid port 120 and an intermediate heat exchange portion 103 arranged in between the first and second longitudinal end portions.

Each of the pressed heat exchanger plates 201 further comprises a pressed pattern P forming a corrugated pattern with tops T and bottoms B in the thickness direction d and as described above. The pressed pattern P comprises in the respective first and second longitudinal end portions 101, 102 a first fluid channel pattern FCP1 leading fluid flow into the at least one fluid and/or a second fluid channel pattern FCP2 bypassing the at least one fluid port. The pressed pattern P further comprises in the intermediate heat exchange portion 103 a third fluid channel pattern FCP3 in fluid communication with the first fluid channel pattern FCP1 and/or second fluid channel pattern FCP2, and comprises a plurality of longitudinally extending wave-shaped pressed lines 1030 configured to form discrete fluid channels in the longitudinal direction (I) of the pressed heat exchanger plate when the pressed heat exchanger plate 201 is attached to the flat plate 201'. In the heat exchanger, the first, second and third fluid channel patterns (FCP1; FCP2; FCP3) form discrete fluid channels with a contact surface along the length of the fluid channel patterns when pressed towards the flat plates 201' in the stack 301.

The heat exchangers may be configured for different types of flow directions. Therefore, the pressed pattern P, and especially the first and second fluid channel patterns in the pressed heat exchanger plates 201 may be adapted to the desired flow directions.

As shown in the pressed heat exchanger plates 201 of FIGS. 4*a* and 4*b*, every second of the pressed heat exchanger plates 201 comprises in the respective first and second longitudinal end portions 101; 102 one fluid port 110; 120. As best shown in FIGS. 4*a* and 4*b*, every other plate is of the type where the first fluid channel pattern FCP1 leads fluid flow into the fluid ports 110; 120 (see FIG. 4*b*), and every other of the pressed heat exchanger plates 201 comprises a second fluid channel pattern FCP2 bypassing the at least one fluid port 110; 120, see FIG. 4*a*. A flat plate 201' is positioned in between the pressed plates 201. In this way, in the plate heat exchanger, the cold flow may form a flow referred to as "U-flow" and as illustrated by the arrowed lines depicted with "C". The cold flow C enters the first longitudinal end portion 101 from above and the flow is directed by the first flow pattern FCP1 through the channels in the intermediate portion 103. The flow exits the pressed plate 201 via the second port 120 in the second longitudinal portion 102.

The heat exchanger modules 200 described above are arranged in stacks 301 in a heat exchanger. The plate heat exchanger may comprise at least two stacks 301 arranged in parallel in the plate heat exchanger 1. FIG. 5 illustrates an example of a heat exchanger which comprises nine parallel heat exchanger stacks 301 of heat exchanger plate modules 200 comprising the pressed heat exchanger plates 201 and flat plates 201' in between the pressed plates as shown in FIGS. 1*b*, 4*a* and 4*b*. The parallel stacks may be obtained by attaching the nine modules together along two opposing longitudinal sides of the modules. Alternatively, the pressed plates may be integrated together into one wide plate in which the nine pressed patterns are arranged in parallel on one plate, each pattern corresponding to the pressed pattern of a pressed heat exchanger plate of a module.

In the illustrated example in FIG. 5, the cold flow C is arranged as a "U-flow". Reference is made also to FIGS. 6*a* and 6*b* in which the hot and cold flows H, C, respectively, are shown in more detail in connection with a nine parallel pressed plate patterns. The reference signs are added on the left-hand side of the drawing only, but the reference signs apply to the whole drawing. As shown in FIG. 6*a*, the hot fluid H flows along the discrete channels formed by the third flow channel pattern FCP3 in the intermediate portion 103 of the pressed plate 201 and bypasses the first and second ports 110, 120 in the channels formed by the second flow pattern FCP2 in the respective first and second end portions 101 and 102 of the integrated pressed plate 2010. As shown in FIG. 6*b*, the cold fluid C flows along the discrete channels formed by the third flow channel pattern FCP3 in the intermediate portion 103 of the integrated pressed plate 2010 and is lead into the first and second ports 110, 120 in the channels formed by the first flow pattern FCP1 in the respective first and second end portions 101 and 102 of the pressed plate 2010.

In FIG. 7*a* a heat exchanger 1 configured for a "Z-flow" variant is shown and in FIG. 7*b* a detailed view of how the hot and cold flows H, C are arranged in one pressed heat exchanger plate 201 when the heat exchanger 1 is configured for the "Z-flow". Analogously with the variant shown in FIGS. 6*a* and 6*b*, the pressed plate of FIG. 7*b* can be arranged into one integrated wide plate 2010, in which nine parallel pressed patterns P are arranged into one plate.

FIG. 7*b* is a partially cut view of an upper pressed plate 201 and a flat plate 201' centrally in the longitudinal direction of the plate. The lower pressed plate 201 comprises the second flow channel pattern FCP2 in the respective first and second end portions 101, 102 so that the hot flow H can bypass the first and second ports 110, 120. The upper pressed plate 201 comprises a first flow channel pattern FCP1 in the respective first and second end portions 101, 102, whereby the cold flow is lead into the first and second ports 110, 120, respectively. It can be seen that the cold flow is lead into the first port 110 from the underside of the pressed plates 201, whereby the cold fluid C flows along the discrete channels formed by the third flow channel pattern FCP3 in the intermediate portion 103 of the pressed plate 201 through the second port 120 towards the opposite direction compared to the incoming cold fluid C. This can be seen also from FIG. 7*a* illustrating a plate heat exchanger 1 with nine parallel stacks 301 of plates 201, 201', in which the first port 110 is arranged on the front side of the heat exchanger 1 in the illustrated view and the second port 120 (port not shown) is arranged on the back side of the heat exchanger in the illustrated view.

In FIG. 8*a* a heat exchanger 1 configured for a "L-flow" variant is shown and in FIG. 8*b* a detailed view of the pressed plate 201 configured for the heat exchanger with a "L-flow" is shown. FIG. 8*b* shows a pressed plate 201 which comprises the first flow channel pattern FCP1 in the second end portion 102 so that the cold fluid flow C can enter the pressed heat exchanger plate 201 via the second port 120. The pressed plate 201 comprises in the first end portion 101 the second flow channel pattern FCP2, so that the cold flow can bypass the first port 110. It can be seen from FIG. 8*a* that the cold flow C can be led into the second port 120 from the front of the heat exchanger 1. The cold fluid C flows along the discrete channels formed by the third flow channel pattern FCP3 in the intermediate portion 103 of the pressed plate 201 and then bypasses the first port 110, thus in a "L-flow". This can be seen also from FIG. 8*a* illustrating a plate heat exchanger with nine parallel stacks 301 of plates 201, 201' or stacks of integrated plates 1020 having nine parallel ports, in which the second port 120 is arranged on the front side of the heat exchanger 1 in the illustrated view. The hot flow H may be arranged in a similar manner, but in a countercurrent way to flow into the heat exchanger 1. The hot flow H may thus enter the heat exchanger 1 from the back of the heat exchanger via the second port 120, and flow along the third flow channel pattern FCP3 in the intermediate portion 103 of the pressed plate 201 and then it bypasses the first port 110, thus in a "L-flow". As is evident, the respective hot and cold flows may be arranged to enter and leave the heat exchanger plate in many different ways.

In the heat exchanger of FIG. 8*a* as well as in the heat exchanger of the type shown in FIGS. 1*a*, 1*b* and 2, it is to be noted that in the plate heat exchanger 1 of this type, every second of the pressed heat exchanger plates 201, which either comprises in the respective first and second longitudinal end portions 101; 102 one or two fluid ports and a first fluid channel pattern FCP1 leading fluid flow into one of the fluid ports and/or a second fluid channel pattern FCP2 bypassing the other one of the fluid ports, is fixed to the flat plate 201' with a first surface facing the flat plate, and every other of the pressed heat exchanger plates 201 is fixed to the flat plate with a second, opposing, surface facing the flat plate. In this way, the pressed plates are attached to the flat plates in an alternating manner and only one pressing tool is required to provide the pressed plates.

Generally, the plate heat exchanger may be a recuperative heat exchanger with a counter-flow energy recovery. Recuperative heat exchangers are efficient and provide good heat transfer rates per unit surface area.

The heat exchanger may comprise in addition to the internal fluid ports 110; 120; 130; 140 at least one external fluid connector 8, as shown by FIG. 2. The fluid flows may be collected in the external connectors, which may be especially advantageous in the heat exchanger configured for the "L-flow" and as illustrated in FIGS. 8*a* and 8*b*.

The plate heat exchanger of the present disclosure may be configured for heat exchange between two fluids, wherein the fluids can be gases. The plate heat exchanger may be configured for high pressure applications.

The present disclosure further relates to a process for the production of a heat exchanger plate module as described above. The process comprises

- cutting a sheet metal material so as to provide two or more metallic plates having an extension in a longitudinal (l) direction, transversal (t) direction perpendicular to the longitudinal direction and thickness direction (d) of the plate,
- pressing at least one of the metallic plates in a pressing tool, whereby the pressing tool is configured to provide a pressed pattern P to the heat exchanger plate,
- providing a flat plate having corresponding outer shape and dimension as the pressed plate in the longitudinal and transversal direction,
- providing a heat exchanger plate module comprising a pressed plate and a flat plate,
- assembling a stack of heat exchanger plate modules such that every second plate is a pressed heat exchanger plate (201), and every other is a flat plate (201'),
- joining the modules together to provide a plate heat exchanger comprising the stack of heat exchanger modules.

The present invention also relates to a plate heat exchanger comprising a frame and a plurality of stacked heat exchanger plate modules. The joining of the modules to provide a heat exchanger can be performed by fusion bonding, brazing, welding or by diffusion welding. The heat exchanger may according to an alternative be a gasketed heat exchanger.

The person skilled in the art realizes that the present invention is not limited to the examples described above. The person skilled in the art further realizes that modifications, combinations and variations are possible within the scope of the appended claims. Additionally, variations to the disclosed embodiments can be understood and effected by the skilled person in practicing the claimed invention, from a study of the drawings, the disclosure, and the appended claims.

The invention claimed is:

1. A heat exchanger plate module comprising a pressed heat exchanger plate and a flat plate, the pressed heat exchanger plate and the flat plate having two opposite side surfaces, an extension in a longitudinal direction, transversal direction perpendicular to the longitudinal direction and thickness direction of the plate, wherein the plates have substantially the same outer shape in the longitudinal and transversal direction, the plates in the module comprising:

- a first longitudinal end portion comprising at least one first fluid port,
- a second longitudinal end portion comprising at least one second fluid port,
- an intermediate heat exchange portion arranged in between the first and second longitudinal end portions, wherein
- the pressed heat exchanger plate further comprises a pressed corrugated pattern with alternating tops and bottoms in the thickness direction of the pressed plate, the pressed pattern comprising:
- in the first and/or second longitudinal end portions, a first fluid channel pattern leading fluid flow into the at least one first fluid port and/or a second fluid channel pattern bypassing the at least one second fluid port,
- in the intermediate heat exchange portion, a third fluid channel pattern in fluid communication with the first fluid channel pattern and/or a second fluid channel pattern, and comprising a plurality of longitudinally extending pressed lines configured to form discrete fluid channels in the longitudinal direction of the heat exchanger plate module, when the pressed heat exchanger plate is attached to the flat plate, each of the longitudinally extending pressed lines being a longitudinally extending sinusoidal-shaped pressed line.

2. The heat exchanger plate module according to claim 1, wherein the flat plate is attached to the pressed heat exchanger plate along the extension of the first fluid channel pattern, the second fluid channel pattern and the third fluid channel pattern.

3. The heat exchanger plate module according to claim 1, wherein the first fluid channel pattern and/or the second fluid channel pattern forms a discontinuous pattern with the third fluid channel pattern with an interrupting portion between the first and/or the second fluid channel patterns and the third fluid channel pattern.

4. The heat exchanger plate module according to claim 3, wherein the amount of fluid channels formed by the respective first fluid channel pattern and the second fluid channel pattern in the pressed plate together with the flat plate is less than the amount of discrete flow channels formed by the third fluid channel pattern in the pressed plate and the flat plate.

5. The heat exchanger plate module according to claim 1, wherein the first longitudinal end portion comprises-two first fluid ports, and the second longitudinal end portion comprises two second fluid ports.

6. The heat exchanger plate module according to claim 5, wherein the respective first and second longitudinal end portions comprise the first and second fluid channel patterns leading fluid flow into the at least one fluid port and/or bypassing the at least one fluid port, and wherein the first and second fluid channel patterns are configured to provide a diagonal or parallel flow between the fluid ports in the first and second longitudinal end portions.

7. The heat exchanger plate module according to claim 5, wherein the respective first and second longitudinal end portions comprise the first and second fluid channel patterns leading fluid flow into the at least one fluid port and/or bypassing the at least one fluid port, and wherein the first and second fluid channel patterns are configured to provide a parallel flow between the fluid ports in the first and second longitudinal end portions.

8. The heat exchanger plate module according to claim 1, wherein the pressed heat exchanger plate and the flat plate have a thickness of from 0.25 to 5.0 mm, or from 0.3 to 3.0 mm.

9. The heat exchanger plate module according to claim 1, wherein the pressing depth of the fluid channel patterns is at least 0.5 mm.

10. A plate heat exchanger comprising a plurality of stacked heat exchanger plate modules, wherein in the stack the modules are arranged such that every second plate is a pressed heat exchanger plate, and every other is a flat plate, wherein each of the flat and pressed heat exchanger plates has two opposite side surfaces, an extension in a longitudinal direction, transversal direction perpendicular to the longitudinal direction and thickness direction of the plate, the flat and pressed heat exchanger plates comprising a first longitudinal end portion comprising at least one first fluid port, a second longitudinal end portion comprising at least one second fluid port, an intermediate heat exchange portion arranged in between the first and second longitudinal end portions, wherein the pressed heat exchanger plate further comprises a pressed pattern forming a corrugated pattern with alternating tops and bottoms in the thickness direction of the pressed plate, the pressed pattern comprising:

in the first and/or second longitudinal end portions, a first fluid channel pattern leading fluid flow into the at least one first fluid port and/or a second fluid channel pattern bypassing the at least one second fluid port, in the intermediate heat exchange portion, a third fluid channel pattern in fluid communication with the first fluid channel pattern and/or second fluid channel pattern, and comprising a plurality of longitudinally extending pressed lines configured to form finned discrete fluid channels in the longitudinal direction of the pressed heat exchanger plate, when the pressed heat exchanger plate is attached to the flat plate, each of the longitudinally extending pressed lines being a longitudinally extending sinusoidal-shaped pressed line.

11. The plate heat exchanger of claim 10, wherein the flat plate of each module is attached to a pressed plate of the respective module and to a pressed plate of a neighboring module, wherein the first, second and third fluid channel patterns form discrete fluid channels with a contact surface along the length of the fluid channel patterns.

12. The plate heat exchanger of claim 10, wherein every second of the pressed heat exchanger plates comprises in the respective first and second longitudinal end portions the first fluid channel pattern leading fluid flow into at least one of the first fluid port and the second fluid port, and every other of the pressed heat exchanger plates comprises in the respective first and second longitudinal end portions the second fluid channel pattern bypassing the at least one of the first fluid port and the second fluid port.

13. The plate heat exchanger of claim 10, wherein every second of the pressed heat exchanger plates, which comprises in the first longitudinal end portion two of the first fluid ports, in the second longitudinal end portion two of the second fluid ports and a first fluid channel pattern leading fluid flow into one of the first fluid ports and a second fluid channel pattern bypassing one of the first fluid ports, is fixed to the flat plate with a first surface facing the flat plate, and every other of the pressed heat exchanger plates is fixed to the flat plate with a second, opposing, surface facing the flat plate.

14. The plate heat exchanger of claim 10, wherein the plate heat exchanger is configured so that stacks of at least two heat exchanger plate modules are arranged in parallel by attaching the modules together along two opposing longitudinal sides of the modules, or wherein at least two pressed patterns are arranged in parallel on one plate, each pattern corresponding to the pressed pattern of a pressed heat exchanger plate of a module.

15. The plate heat exchanger of claim 10, wherein the fluid ports are connectable to an external fluid connector.

16. The plate heat exchanger of claim 10, wherein the plate heat exchanger is configured for heat exchange between two gases.

17. The plate heat exchanger of claim 10, wherein the plate heat exchanger is configured for high pressure applications.

18. Process for the production of a plate heat exchanger according to claim 10, the process comprising cutting a sheet metal material so as to provide two or more metallic plates having an extension in a longitudinal direction, transversal direction perpendicular to the longitudinal direction and thickness direction of the plate, pressing at least one of the metallic plates in a pressing tool, whereby the pressing tool is configured to provide a pressed pattern P to the heat exchanger plate, providing a flat plate having corresponding outer shape and dimension as the pressed plate in the longitudinal and transversal direction, providing a heat exchanger plate module comprising a pressed plate and a flat plate, assembling a stack of heat exchanger plate modules such that every second plate is a pressed heat exchanger plate, and every other is a flat plate, joining the modules together to provide a plate heat exchanger comprising the stack of heat exchanger modules.

19. A heat exchanger plate module comprising a pressed heat exchanger plate and a flat plate, the pressed heat exchanger plate and the flat plate having two opposite side surfaces, an extension in a longitudinal direction, transversal direction perpendicular to the longitudinal direction and thickness direction of the plate, wherein the plates have substantially the same outer shape in the longitudinal and transversal direction, each plate in the module comprising:

a first longitudinal end portion comprising at least one first fluid port, a second longitudinal end portion comprising at least one second fluid port, an intermediate heat exchange portion arranged in between the first and second longitudinal end portions, the intermediate heat exchange portion being bounded by the first longitudinal end portion, the second longitudinal end portion, and first and second opposite edges of the plate, wherein the pressed heat exchanger plate further comprises a pressed corrugated pattern with alternating tops and bottoms in the thickness direction of the pressed plate, the pressed pattern comprising:

in the first and/or second longitudinal end portions, a first fluid channel pattern leading fluid flow into the at least one first fluid port and/or a second fluid channel pattern bypassing the at least one second fluid port, in the intermediate heat exchange portion, a third fluid channel pattern in fluid communication with the first fluid channel pattern and/or a second fluid channel pattern, and comprising a plurality of longitudinally extending pressed lines configured to form discrete fluid channels in the longitudinal direction of the heat exchanger plate module when the pressed heat exchanger plate is attached to the flat plate, each of the longitudinally extending pressed lines being wave-shaped so that the longitudinally extending pressed line includes plural portions in each of which the pressed line extends towards the first edge of the plate and then extends towards the second edge of the plate.

* * * * *